US005729081A

United States Patent [19]

Hoffmann et al.

[11] Patent Number: 5,729,081

[45] Date of Patent: Mar. 17, 1998

[54] ELECTRODE COIL FOR DISCHARGE LAMPS AND METHOD FOR PRODUCING SUCH AN ELECTRODE COIL

[75] Inventors: Roland Hoffmann, Augsburg; Erolf Weinhardt, Diedorf, both of Germany

[73] Assignee: Osram Sylvania Inc., Danvers, Mass.

[21] Appl. No.: 678,022

[22] Filed: Jul. 10, 1996

[30] Foreign Application Priority Data

Jul. 28, 1995 [DE] Germany ..... 195 27 653.1

[51] Int. Cl.[6] ..... H01K 1/14; H01J 61/06

[52] U.S. Cl. ..... 313/344; 313/343; 313/578; 313/491; 313/632; 140/71.5

[58] Field of Search ..... 313/344, 343, 313/341, 578, 631, 632, 350, 491; 140/71 R, 71.5

[56] References Cited

U.S. PATENT DOCUMENTS

| | | | |
|---|---|---|---|
| 2,218,345 | 10/1940 | Spaeth | 313/344 X |
| 2,329,118 | 9/1943 | Inman | 313/344 X |
| 2,394,474 | 2/1946 | Peters | 313/344 |
| 2,479,192 | 8/1949 | Zabel | 313/344 X |
| 3,069,581 | 12/1962 | Lemmers | 313/344 X |
| 3,189,778 | 6/1965 | Brundige | 313/271 X |
| 3,294,125 | 12/1966 | Heine | 313/344 X |
| 3,725,720 | 4/1973 | Petro et al. | 313/344 |
| 3,729,787 | 5/1973 | Rively et al. | 29/25.18 |
| 3,736,458 | 5/1973 | Miller, Jr. et al. | 313/344 |
| 3,908,251 | 9/1975 | Roy et al. | 313/344 X |
| 4,277,714 | 7/1981 | Keeffe et al. | 313/217 |
| 4,506,187 | 3/1985 | Hoffman et al. | 313/344 X |
| 5,258,687 | 11/1993 | Duggan et al. | 313/344 X |

FOREIGN PATENT DOCUMENTS

| | | |
|---|---|---|
| 0 700 070 A2 | 3/1996 | European Pat. Off. . |
| A-56 106359 | 8/1981 | Japan . |
| A-1 034 080 | 6/1966 | United Kingdom . |

*Primary Examiner*—Ashok Patel
*Attorney, Agent, or Firm*—Carlo S. Bessone

[57] ABSTRACT

The invention relates to electrode coils for discharge lamps having a coiled wire (1) which is wound around by a braiding wire (2). The coiled wire (1) has both turns (II) with an essentially circular cross-section and turns (I, III) with an oval cross-section. In order to produce the bar-shaped coil according to the invention, the unit comprising the coiled wire (1), the first core wire (3) and the braiding wire (2) is wound around a second core wire (4) which is flattened in places. Unrolling of the braiding wire (2) is prevented thereby. Production of the coil is cost-effective, since only two core wires are required and the coil ends are not fused.

6 Claims, 2 Drawing Sheets

Figure 4:
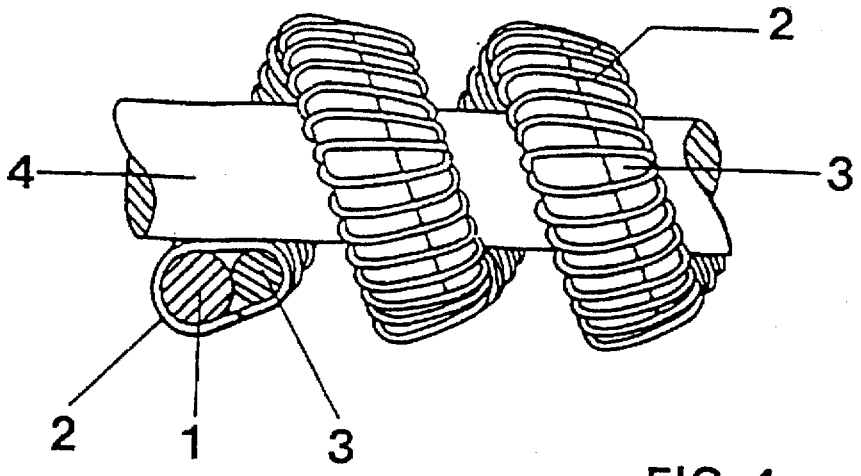

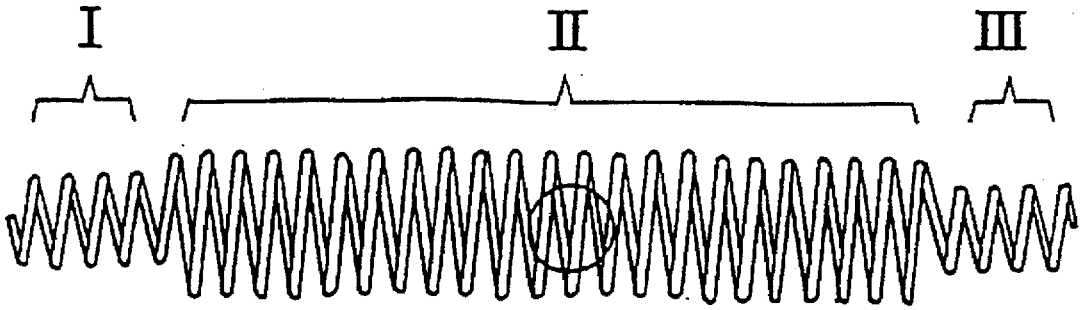
FIG. 1
FIG. 2
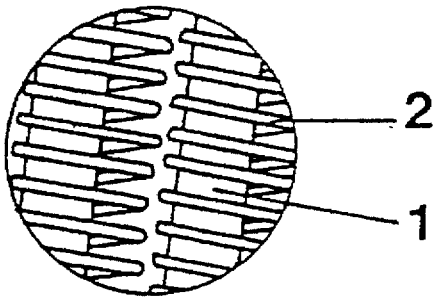
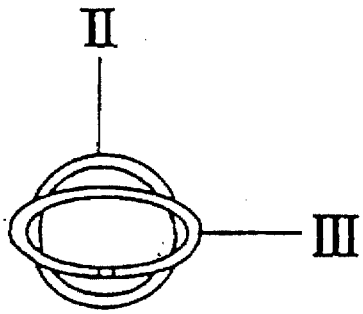
FIG. 3

ELECTRODE COIL FOR DISCHARGE LAMPS AND METHOD FOR PRODUCING SUCH AN ELECTRODE COIL

The invention relates to an electrode coil for discharge lamps, as well as to a method for producing such an electrode coil.

Such an electrode coil is disclosed, for example, in U.S. Pat. No. 3,729,787. This electrode coil has a coiled tungsten wire which is loosely wound around by a braiding wire. In order to produce this coil, the braiding wire is wound around the coiled tungsten wire and around a first core wire arranged parallel to the tungsten wire and, subsequently, the unit composed of coiled tungsten wire, first core wire and braiding wire is wound around a second core wire. As a result, the turns of the electrode coil or the coiled tungsten wire have an essentially circular cross-section throughout. The two core wires are dissolved out of the coil in an acid bath. In order to prevent unwinding of the braiding wire, the ends of the electrode coil are fused in accordance with the abovementioned patent. Such a fusing of the coil ends has, however, the disadvantage that the useful coil length is reduced by approximately 10–15% and therefore requires a correspondingly higher material consumption.

The U.S. Pat. No. 3,736,458 likewise describes an electrode coil having a coiled tungsten wire which is loosely wound around by a braiding wire. The turns of the electrode coil or the coiled tungsten wire do not, as in U.S. Pat. No. 3,729,787, have, however, an essentially circular cross-section but an oval cross-section throughout. This shape is intended to prevent unwinding of the braiding wire. However, it is disadvantageous in the electrode coil in accordance with U.S. Pat. No. 3,736,458 that three core wires are required to produce this electrode coil.

It is the object of the invention to provide an electrode coil for discharge lamps whose braiding wire is adequately secured against unrolling, and which can be produced as cost effectively as possible.

The electrode coil according to the invention has a coiled wire which has both turns with an essentially circular cross-section and turns with an oval cross-section. The braiding wire is reliably fixed against unrolling by the coil sections in which the turns have an oval cross-section, with the result that fusing of the coil ends is unnecessary. Moreover, only two core wires are required to produce the electrode coil according to the invention. Cost-effective fabrication of the coil is thereby rendered possible. The coil sections in which the turns of the coiled wire have an oval cross-section are advantageously located at the coil ends, since here the risk of the braiding wire unrolling is highest. It is advantageous in the case of long coils also to provide outside the coil ends further coil sections which have turns with an oval cross-section. These coil sections are preferably arranged regularly or equidistantly along the coil. The coil sections whose turns have an oval cross-section are advantageously produced with the aid of a second core wire which is flattened at regular intervals. Wound around this second core wire is the unit comprising the coil wire, the first core wire, arranged parallel thereto, and the braiding wire. When the coiled wire is wound onto the second core wire, turns with an oval cross-section are produced in the flattened sections of the second core wire, while turns with an essentially circular cross-section are formed in the non-flattened regions of the core wire.

The invention is explained in more detail below with the aid of a preferred exemplary embodiment.

Figure 5:
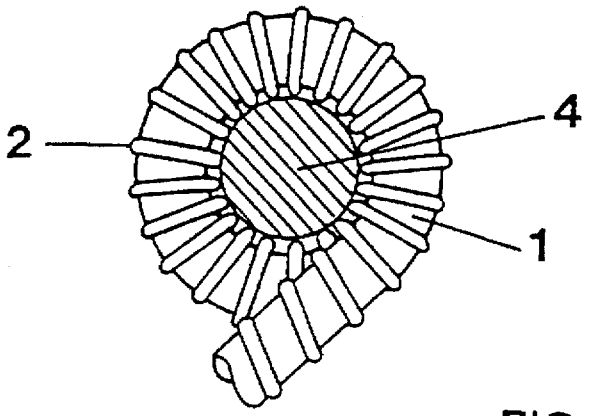
Figure 6:
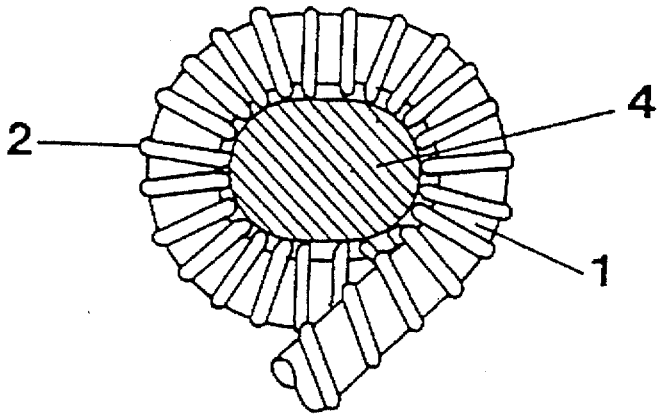

FIG. 1 shows a diagrammatic side view of an electrode coil according to the invention in accordance with a preferred exemplary embodiment, FIG. 2 shows an enlarged representation of a detail (diagrammatic) of the electrode coil from FIG. 1, FIG. 3 shows a top view (diagrammatic) of an end of the electrode coil according to the invention in accordance with FIG. 1, FIG. 4 shows a side view of a nonflattened coil section of the electrode coil according to the invention and illustrated in FIG. 1, with core wires, FIG. 5 shows a cross-section (diagrammatic) through the non-flattened coil section of the electrode coil according to the invention and illustrated in FIG. 1, with core wire, and FIG. 6 shows a cross-section (diagrammatic) through the flattened coil section of the electrode coil according to the invention and illustrated in FIG. 1, with core wire.

A preferred exemplary embodiment of the electrode coil according to the invention is represented diagrammatically in FIG. 1. This is a bar-shaped electrode coil for a linear fluorescent lamp with an electric power consumption of approximately 58 W. This electrode coil is fitted with end sections I, III in which the turns of the coiled wire 1 (FIG. 2) have an oval cross-section, while in the middle coil section II the turns of the coiled wire 1 have an essentially circular cross-section. The end sections I, III respectively extend over a length of approximately 0.5 mm, while the middle coil section II is approximately 10 mm long. The diameter of the electrode coil is approximately 1.2 mm in the middle section II. FIG. 2 is an enlargement of a detail of the middle coil section II of the electrode coil, according to the invention, of FIG. 1. It shows the structure of the electrode coil according to the invention. The electrode coil comprises a singly coiled tungsten wire 1 which is loosely wound around over its entire length by a thinner braiding wire 2, likewise consisting of tungsten. The wire thicknesses are approximately 71 μm for the coiled tungsten wire and approximately 20 μm for the braiding wire. It is to be seen from the diagrammatic FIG. 3 that the large radius of the turns with an oval cross-section in the coil sections I, III is larger than the radius of the turns, belonging to the section II, with an essentially circular cross-section, while the small radius of the turns with an oval cross-section in the coil sections I, III is smaller than the radius of the turns, belonging to the section II, with an essentially circular cross-section.

In order to produce the electrode coil according to the invention, the initially still uncoiled tungsten wire 1 is aligned parallel to a first core wire 3 consisting of iron. The tungsten wire 1 and the core wire 3 are then wound around by the braiding wire 2. It follows from the diagrammatic FIG. 4 that the first core wire 3 has a somewhat smaller wire thickness than the coil wire 1. The unit comprising the coiled tungsten wire 1, the first core wire 3 and the braiding wire 2 is now for its part wound around a second core wire 4, which likewise consists of iron and has a diameter of approximately 1 mm. The second core wire 4 is flattened at equidistant intervals of approximately 10 mm, that is to say its dimension in the pinching direction is reduced to approximately 80% of the diameter. The length of these flattened sections is approximately 1 mm. As a result, the turns of the coiled tungsten wire 1 are lent an oval cross-section in the flattened core-wire sections, while the turns of the electrode coil or of the coiled tungsten wire 1 have an essentially circular cross-section in the non-flattened core-wire sections. It may be remarked here that owing to the pinching operation the dimension of the flattened core-wire sections at right angles to the pinching direction and to the coil axis is larger than the diameter of the non-flattened core-wire sections. FIG. 4 shows a detail of a side view of a nonflattened section of the second core wire of the electrode coil with the coil wire 1, the first core wire 3 and the braiding wire 2. A cross-section through this coil section illustrated in FIG. 4 is represented in FIG. 5. The turns of the coiled tungsten wire 1 together with the braiding wire 2 surrounding it have an essentially circular cross-section in this coil section. After the two core wires 3, 4 have been etched out, this coil section corresponds to the coil section II illustrated in FIG. 2 and in FIG. 1.

FIG. 6 shows a cross-section through a flattened section of the second core wire 4 together with the coil wire 1, which is wound around it and is, for its part, wrapped around by the braiding wire 2. The turns of the coiled tungsten wire 1 together with braiding wire 2 surrounding it have an oval cross-section in this coil section.

After termination of the winding operations, the wires 1, 2, 3, 4 are severed in the middle of the flattened sections of the core wire 4. Electrode coils with flattened coil ends are produced in the process. Subsequently, the two core wires 3, 4 are dissolved out in an acid bath. Remaining as a result at the coil ends are coil sections I, III (FIGS. 1, 3) approximately 0.5 mm long, whose turns have an oval cross-section, while the middle coil section II has turns with an approximately circular cross-section. The electrode coils are subsequently mounted in a known way in an electrode mount and immersed in an emitter paste. The further assembly of the electrode mounts is performed in a known way and is not therefore to be further described here.

The invention is not restricted to the exemplary embodiment described in detail above. Thus, the electrode coils according to the invention can, for example, also have additional coil sections with an oval cross-section outside the coil ends. This embodiment is particularly advantageous in comparatively long bar-shaped coils. The interval between the flattened sections of the second core wire 4 can, for example, be shortened to approximately 4.5 mm. In this case, the electrode coil according to the invention as explained in more detail above still contains precisely one additional coil section which is arranged in the coil middle and in which the coil wire has turns in an oval cross-section whose length is approximately 1 mm. Extending on both sides of this section is then one coil section each approximately 4.5 mm long, in which the turns of the coil wire have an approximately circular cross-section. As before, the coil ends are formed by two sections approximately 0.5 mm long in which the turns of the coil wire have an oval cross-section, with the result that the overall length of the electrode coil remains unchanged.

The core wires 3, 4 need not necessarily consist of iron, but can also be fabricated, for example, from molybdenum. Furthermore, the invention can also be applied to triple coils, for example by winding the core wire 4 together with the wires 1, 2, 3 located thereupon around a further core wire.

We claim:

1. Electrode coil for discharge lamps having a coiled wire (1) which is wound around by a braiding wire (2), the electrode coil having a longitudinal axis, characterized in that the coiled wire (1) has both turns (II) with an essentially circular cross-section with respect to the longitudinal axis and turns (I, III) with an oval cross-section with respect to the longitudinal axis.

2. Electrode coil according to claim 1, characterized that the large radius of the turns (I, III) with an oval cross-section is larger than the radius of the turns (II) with an essentially circular cross-section, and in that the small radius of the turns (I, III) with an oval cross-section is smaller than the radius of the turns (II) with an essentially circular cross-section.

3. Electrode coil according to claim 1, characterized in that the coiled wire (1) has at the ends of the electrode coil turns (I, III) which have an oval cross-section.

4. Electrode coil according to claims 1 or 3, characterized in that the electrode coil has at least one coil section arranged at the coil ends in which the turns of the coiled wire (1) have an oval cross-section.

5. Electrode coil according to claim 1, characterized in that the electrode coil has at regular intervals sections in which the turns of the coiled wire (1) have an oval cross-section.

6. Electrode coil according to claim 5, characterized in that the sections in which the turns of the coiled wire (1) have an oval cross-section are arranged equidistantly.

* * * * *